US006128792A

United States Patent [19]

Mathews

[11] Patent Number: 6,128,792

[45] Date of Patent: Oct. 10, 2000

[54] RETRACTABLE AERATOR

[75] Inventor: Lester Mathews, Phoenix, Ariz.

[73] Assignee: Caretaker Systems, Inc., Scottsdale, Ariz.

[21] Appl. No.: 09/323,664

[22] Filed: Jun. 1, 1999

[51] Int. Cl.[7] ..... E04H 4/00

[52] U.S. Cl. ..... 4/508; 4/490

[58] Field of Search ..... 4/508, 492, 490, 4/541.6; 239/204, 205, 206, 571, 533.15

[56] References Cited

U.S. PATENT DOCUMENTS

| | | | |
|---|---|---|---|
| 4,271,541 | 6/1981 | Mathews | 4/490 |
| 4,371,994 | 2/1983 | Mathews | 4/490 |
| 4,466,142 | 8/1984 | Gould | 4/490 |
| 4,939,797 | 7/1990 | Goettl | 4/490 |
| 5,251,343 | 10/1993 | Goettl | 4/490 |

*Primary Examiner*—Steven O. Douglas
*Assistant Examiner*—Khoa D. Huynh
*Attorney, Agent, or Firm*—LaValle D. Ptak

[57] ABSTRACT

A swimming pool aerator is designed with a base member secured to the end of a water return pipe above the water surface in the side of a pool or water feature basin. The base member carries a retractable spray nozzle, which normally is biased to retract into the wall of the pool through the base member. When water is applied to the supply line under pressure, an aerator nozzle is moved from a rest position to an extended position against the action of a biasing spring to spray water into the pool. When the pressure or supply is turned off, the aerator nozzle is retracted back into the base portion by the biasing spring to a position safely out of the way of swimmers or users of the pool.

8 Claims, 1 Drawing Sheet

RETRACTABLE AERATOR

BACKGROUND

Swimming pools and water features built in sunbelt areas of the world have a tendency to become very warm in the summer. The warmer water causes a swimming pool to be uncomfortable for swimming and dramatically increases the need for disinfecting chemicals. In order to effect cooling of the water, spray aerator nozzles are mounted around the swimming pool, above the water surface. When water under pressure is supplied through these nozzles, they spray a fine mist of water over the surface of the pool. This process cools the water in the spray through evaporation of some of the water; and the water which then falls back into the pool functions to cool the body of water in the pool.

Typically, aerators which are used by swimming pool builders throughout the southwest United States, and in other parts of the world, are in the form of a protruding pipe with an angled 45° slot slanted toward the pool. This device protrudes out from the vertical wall of the pool at or slightly above the water surface, approximately two to three inches. Since the aerator nozzle is mounted near or at the water's edge, the nozzle becomes a safety hazard. Swimmers may bump into or come into contact with the protrusion, causing injury.

It is desirable to provide an aerator for swimming pools and other water features which does not produce the safety hazard of the prior art devices, and which effectively functions to produce aeration cooling in an efficient manner.

SUMMARY OF THE INVENTION

It is an object of this invention to provide an improved aerator for pools.

It is another object of this invention to provide an improved swimming pool aerator.

It is an additional object of this invention to provide an improved swimming pool aerator which reduces the risk of injury resulting from the aerator installation.

It is a further object of this invention to provide an improved retractable aerator for swimming pools and water features which retracts to a recessed position when it is not in use.

In accordance with a preferred embodiment of the invention, a retractable aerator nozzle assembly for a pool includes a base member secured in the end of a water supply line. The base member is open throughout its length and has first and second spaced shoulders in it. A hollow, movable member is mounted for reciprocal movement in the opening in the base member between the shoulders. This hollow movable member has a length which is greater than the distance between the shoulders on the base member. The opposite ends of the movable member carry first and second flanges which engage, respectively, the first and second shoulders in two different positions of operation of the device. A biasing spring biases the movable member to a first rest position, with the first flange engaging the first or outer shoulder of the base member.

The movable member is open at its inner end to receive water under pressure into that end. The opposite end is closed, with a fluid exit opening adjacent that end. When water under pressure is applied to the aerator assembly, the movable member moves against the spring bias to a second position where the second flange engages the second shoulder of the base member. This extends the first end of the movable member beyond the first end of the base member, and water sprays through the fluid exit opening into the pool.

DETAILED DESCRIPTION

Figure 1:
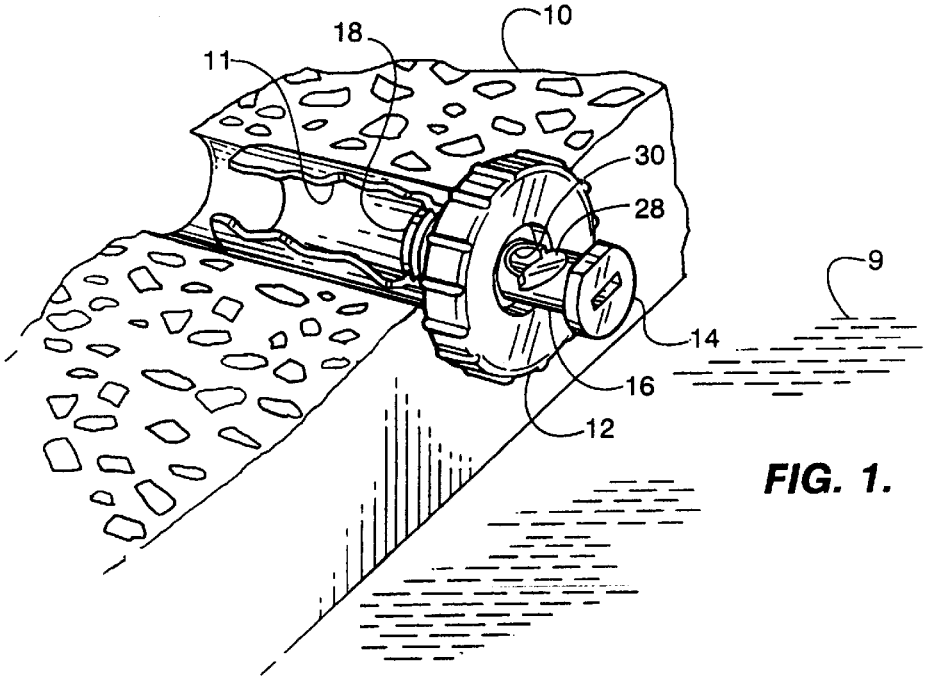
FIG. 1 is a top perspective view of the preferred embodiment of the invention.
Figure 2:
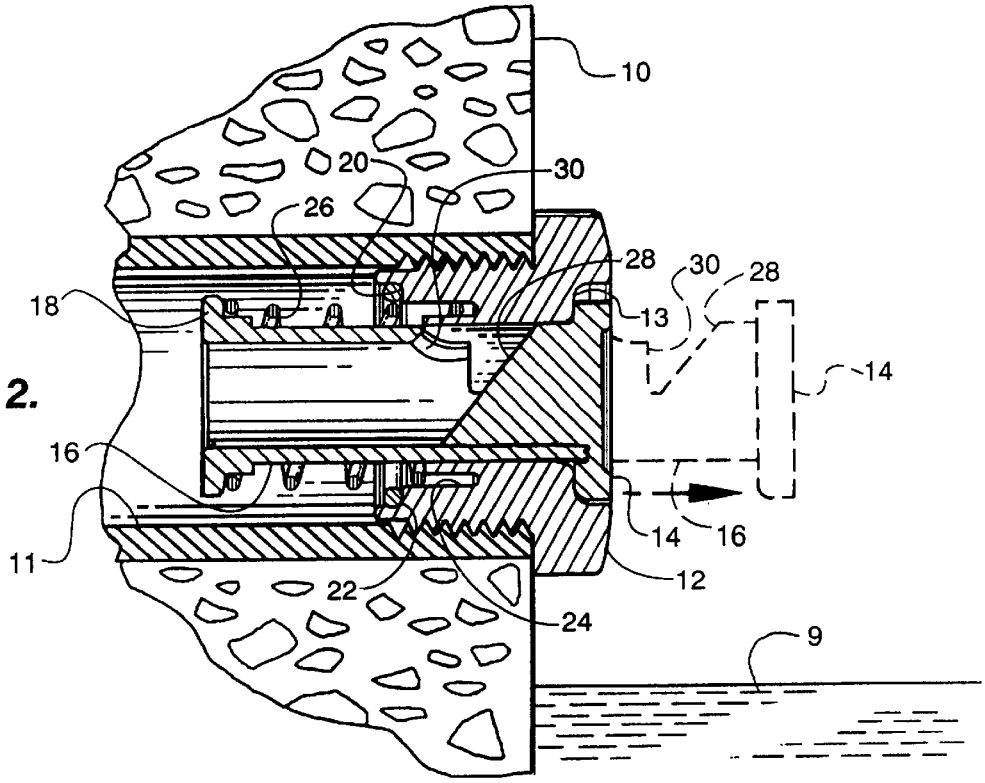
FIG. 2 is a cross-sectional view of the embodiment shown in FIG. 1.

Reference now should be made to the drawings, in which the same reference numbers are used in the different figures to designate the same components. FIGS. 1 and 2 both show a retractable aerator, in accordance with a preferred embodiment of the invention, as mounted into the side wall of a swimming pool or other water feature. Typically, the aerator is located at or just above the water surface of the pool in which it is used.

The pool wall 10 typically includes a supply pipe 11 connected to a suitable source of water (not shown), which selectively may be applied under pressure through the pipe 11 to the aerator, as desired. Normally, under most conditions of use of the pool, no water is supplied through the pipe 11; and the aerator is not used. The pipe 11 and the pool wall 10 are installed in a conventional manner as used with conventional fixed position aerator nozzles of the past. The pipe 11, however, terminates at the outer surface of the pool wall 10, and is internally threaded to receive base member 12 of the aerator assembly.

As shown in FIG. 2, the base member 12 is threaded into engagement with the end of the pipe 11 to secure it in the position shown, with a flange overlying the open outer end of the pipe 11 and a portion of the pool wall 10. This is shown clearly in both FIGS. 1 and 2. The outer edge of the base member 12 may include projections or a knurled surface to facilitate the installation and removal of the aerator assembly, as desired.

In FIG. 2, the assembly is approximately full size. It can be seen that the base member 12 projects only a fraction of an inch beyond the edge of the pool wall 10. To further prevent any potential for injury from contact with the base member 12, the outer edge may be beveled or rounded, as illustrated in FIG. 2, to present a smooth, rounded surface in case a swimmer should happen to bump into the aerator assembly.

The base member 12 includes a recessed first shoulder 13 at its outer end, and an opposing shoulder 20 at its inner end. These two shoulders are spaced apart a short distance (approximately 1") as illustrated in FIG. 2. The shoulder 20 also carries a rubber O-ring 22 around its periphery to effect sealing of the aerator nozzle when it is in its operating position. A cylindrical recess 24 also is formed a slight distance from the hollow interior of the base member 12 to accommodate a coil spring 26, as shown most clearly in FIG. 2.

The assembly is completed by the insertion of a movable nozzle member having a hollow cylindrical body 16 terminated by a closed cap 14 at its outer end. The cap 14 extends as a flange beyond the outer diameter of the main body 16 of the movable nozzle, and is designed to rest against the shoulder 13 in the solid line position shown in FIG. 2 when the device is in its rest or standby condition of operation.

The opposite end of the cylindrical body 16 of the movable nozzle member carries a flange 18 on it; and the spring 26 is compressed between the flange 18 and the bottom of the cylindrical groove 24 formed in the main body 12. The spring 26 is a coil spring; and in its standby state, it is under compression to cause the flange on the cap 14 to rest against the shoulder 13, as indicated in solid lines in FIG. 2.

The bottom end of the cylinder 16 is open; and the cap 14 closes the upper or outer end, as shown in FIGS. 1 and 2. Adjacent the cap 14, below the portion which forms the flange for resting in the shoulder 13, is a diagonally angled (typically, a 45° angle) plug 28 adjacent a slotted opening 30 cut through or formed in the side of the cylindrical body 16. This is shown in both FIGS. 1 and 2. When the device is in its standby position, the top of the cap 14 is flush with the upper surface or outer surface of the main body 12; so that there is no projection of the movable nozzle portion.

When water under pressure is applied to the pipe 11 by any suitable means standard in the industry, the water pressure impinges against the sloped surface 28 and forces the movable body portion outwardly in the direction of the arrow shown in FIG. 2 to the dotted line configuration. This compresses the spring 26, which has a weaker bias than the water pressure which is applied against the sloping flange surface 28. When the device is in its extended position, as shown in dotted lines in FIG. 2, and as shown in FIG. 1, water exits through the opening 30 in the side of the body 16 to spray out in a fan-like pattern commonly used in cooling spray aerators for swimming pools. The nozzle construction for forming the spray of water to cool the pool is the same as conventionally used in fixed position aerators. This configuration may be in different forms from the one illustrated in FIGS. 1 and 2, so long as the opening is sufficiently restricted to allow the water pressure to force the movable aerator body 16 outwardly, as shown in FIGS. 1 and 2, under the pressure of the applied water in the pipe 11.

When the water pressure is released (turned off), the spring 26 forces the flange 18 to the solid line position shown in FIG. 2, causing the lower surface of the top flange 14 to rest on the shoulder 13, as described previously. When the device is in its operating position delivering a flow of water through the slot 30, the upper edge of the flange 18 rests against the O-ring 22 to prevent any leakage around the body 16 of the aerator, and causes all of the water flow to take place in the interior of the body 16 and out through the aerator opening slot 30.

The foregoing description of the preferred embodiment of the invention is to be considered as illustrative and not as limiting. Various changes will occur to those skilled in the art to perform substantially the same function, in substantially the same way, to achieve substantially the same result without departing from the true scope of the invention as defined in the appended claims.

What is claimed is:

1. A retractable aerator nozzle assembly for a pool with water in it for placement in a water supply line opening through a substantially vertical wall of the pool above the water, said nozzle assembly including in combination:

a base member adapted to be secured in an end of an above-water supply line in a substantially vertical wall of a pool, the base member having an opening throughout its length with first and second ends having first and second shoulders thereon, respectively, the first and second shoulders spaced a first predetermined distance apart;

a hollow movable member mounted for non rotatable reciprocal movement in the opening in the base member, the movable member having, a length greater than the first predetermined distance with first and second ends carrying, respectively, first and second flanges for engaging the first and second shoulders, respectively, of the base member, the movable member being open at the second end thereof and closed at the first end thereof, with a fluid exit opening comprising an upwardly facing transverse slot in the side wall adjacent the first end thereof;

a sloped surface located in the hollow interior of the movable member adjacent the slot therein to direct water flow from the second end of the movable member through the slot in the side thereof; and a biasing member coupling the base member and the movable member for biasing the movable member to a first standby position, with the first flange engaging the first shoulder of the base member, so that water under pressure in the base member overcomes the biasing member to move the movable member to a second operating position with the second flange thereof engaging the second shoulder of the base member to extend the first end of the movable member beyond the first end of the base member to allow water to exit through the exit opening of the movable member to spray upwardly and angularly outwardly above water in a pool.

2. The combination according to claim 1 wherein the base member and the movable member both are cylindrical members, with the movable member telescopically mounted in the base member.

3. The combination according to claim 2 wherein the biasing member comprises a spring.

4. The combination according to claim 3 wherein the spring comprises a coil spring encircling the movable member.

5. The combination according to claim 4 wherein the base member and the movable member both are formed of plastic material.

6. The combination according to claim 1 wherein the base member and the movable member both are formed of plastic material.

7. The combination according to claim 1 wherein the biasing member comprises a spring.

8. The combination according to claim 7 wherein the spring comprises a coil spring encircling the movable member.

* * * * *